United States Patent [19]

Forster

[11] Patent Number: 4,574,789

[45] Date of Patent: Mar. 11, 1986

[54] GRAVITY RELIEF APPARATUS

[76] Inventor: Helmut Forster, Greppenstrasse 77, 8031 Alling, Fed. Rep. of Germany

[21] Appl. No.: 613,965

[22] Filed: May 24, 1984

[30] Foreign Application Priority Data

Jun. 27, 1983 [DE] Fed. Rep. of Germany ..... 3323138

[51] Int. Cl.[4] ..... A61H 1/02; A63B 21/12; B66D 3/06; B66D 3/10

[52] U.S. Cl. ..... 128/75; 272/120; 272/900; 248/321; 248/327; 254/393; 254/401; 254/409

[58] Field of Search ..... 128/75; 272/61, 62, 272/120, 121, 143, 144, 900; D8/360; 254/393, 401, 409; 248/320, 321, 327, 328

[56] References Cited

U.S. PATENT DOCUMENTS 2,940,441 6/1960 Demarest et al. ..... 128/75

4,125,257 11/1978 Lew ..... 128/75 X

FOREIGN PATENT DOCUMENTS 622473 9/1978 U.S.S.R. ..... 272/109

*Primary Examiner*—Richard J. Apley
*Assistant Examiner*—Alan W. Cannon
*Attorney, Agent, or Firm*—Wolf, Greenfield & Sacks

[57] ABSTRACT

A handy, compact and easily transportable apparatus for relief of intervertebral discs and for stretching of the vertebrae and the hip joints by means of gravity, having a support element suspendable on a door, a wall or the like, and a suspension device connected with this for the feet, in such manner that even unpracticed and awkward persons without support by a helper, i.e. completely alone, can achieve the suspended position. The suspension device is connected via a cable line with the support element and provided with a coupling device for suspension gaiters.

21 Claims, 7 Drawing Figures

GRAVITY RELIEF APPARATUS

The present invention relates to apparatus for relief of the intervertebral discs and for stretching of the lumbar vertebral column and the hip joints by means of gravity, having a support element which can be hung from a door, a wall or the like, and a suspension device for the feet connected with this.

With known apparatus of this type (cf. for example DE-OS No. 30 07 835) the support element consists of a flat plate which for example can be fixed to a wall or by means of a flexible connecting member can be suspended between the upper edge of a door panel and the lower edge of the associated door frame. On the front side of the door a stirrup is arranged in which the patient suspends himself with his feet and thereby with the head hanging freely downwards is exposed to the sretching or relieving influence of gravity.

It is of advantage in such devices that they are very convenient, need relatively little space and can be transported without problems in a pocket or the like, so that a course of treatment need not be interrupted even when travelling. It is however of disadvantage that it is possible only for practiced and supple patients to achieve the hanging position. To achieve this it is necessary to assume a position with the back to the wall or to the door in a handstand from which the feet can be introduced into the stirrup. This is however only possible for unpracticed and less supple patients with support from a helper who as experience shows is not always available.

It is true that also gravity relieving devices are already known with which it is easily possible for unpracticed or clumsy patients to achieve the hanging position with the aid of a tilting table construction (cf. for example the brochure "Gravity Guiding System"). Such devices have however the disadvantage that they are very expensive and require relatively much space so that they cannot be taken on travels and are practically impossible to install in small flats.

An object of the present invention is so to develop a convenient, easily transportable device occupying little space as described above in such manner that even unpracticed and clumsy persons can reach the hanging position without support from a helper i.e. completely alone.

This object is solved according to the invention in that the suspension device is connected to the support element via a cable line and is provided with a coupling device for gaiters.

The invention is based upon the thought, in a device of the type described in the introduction, of separating the suspension device for the feet on the one hand from the support element and coupling both parts by means of a cable line, and on the other hand to construct the same for coupling of gaiters. Thereby, first of all the coupling of the gaiters can be carried out in a convenient position on the floor and secondly the hanging position can be reached without special bodily dexterity and exertions.

The gaiters can be constructed in any desired manner. Thus, not only known gaiters can be used (cf. for example FIGS. 2 to 5 of U.S. Pat. No. 3,380,447), but also such which can be coupled at the heel side or laterally on the suspension device.

The cable line can likewise be constructed in any desired manner. It is however advantageous to form the cable line as a winch arrangement and to secure the coupling device for the gaiters on the free end of the winch cable.

If the hanging position is to be reached completely without exertion, it is expedient to drive the winch arrangement by an electromotor. Control of the electromotor can in this connection be achieved in the usual manner via a remote control cable or possibly also with known wireless systems.

If a device which is independent of electrical current is required, it is advantageous to construct the winch arrangement as a block and tackle. In such a construction, the patient can move himself into the hanging position and out of this position by muscle power.

It is true that from U.S. Pat. No. 2,938,695 it is already known in such a transportable relief device to produce the necessary force with the use of a Glisson-type sling by means of a pulley arrangement. The thought to equip such a pulley arrangement with a suspension device for the feet and to arrange it in such manner that it can be used as an aid for simple achieving of the hanging position is however not to be found in the U.S. patent.

According to the bodily constitution of the patient, it can be expedient to select the gearing of such a block and tackle to be greater or smaller. The larger the gearing of the block and tackle is selected, the larger is also its self-locking. This has the advantage that on the occurrence of unintentional release of the end of the rope the patient does not fall downwards with high speed but this descending process occurs relatively slowly so that the patient still has the possibility of intervention, whereby the danger of injury, for example in the case of incorrect fixing of the end of the rope, is reduced. Particularly favorable results in respect of gearing and self-locking are reached if the block and tackle has in total four pulleys secured to the support element and four on the suspension device.

Basically, the pulleys of the block and tackle can be mutually arranged in any desired manner. A particularly advantageous construction of the support element and of the suspension device is however possible if the pulleys are arranged in one plane horizontally of one another with their axes lying mutually parallel. In this way, there results a relatively slim longitudinally extending construction of the device which can be easily packed.

When the block and tackle is employed, it is expedient to secure one end of the rope on the support element and to hold the other end releasably in a clamp on the suspension device. In this way, the patient in the hanging position can fix the free end of the block and tackle in an easy manner at any height so that fixing of the rope during the hanging process is not necessary.

Such a clamp can basically be constructed in any desired manner. It is advantageous to use toothed grips, known per se, which have already proved very useful in sailing.

Basically, the clamp can be arranged on the suspension device in any desired manner. It seems however to be particularly advantageous if the clamp is integrated into the pulley housing or the roller boxes.

A particularly compact construction of the apparatus results when the support element and the suspension device are in each case constructed in the form of a pulley housing. A very expedient form of such a pulley housing is created if this is constructed as a longitudinally extending flat rectangular roller box.

Where the suspension device is constructed as a pulley housing, it is advantageous to arrange the coupling device for the gaiters in the region of the front sides, preferably beneath the plane of the roller axes. These coupling devices can be constructed according to the respective form of the gaiters in any desired manner. A particularly simple construction is however achieved if the coupling device is constructed in the form of suspension hooks.

With the use of block and tackles, a correspondingly large length of line is obtained, according to the gearing. It is therefore advantageous if the free end of the line of the block and tackle is coupled to a winding arrangement such as for example is already known for the winding up of dog leads. A particularly advantageous solution is however achieved if the roller box of the suspension device is constructed on its outer side as a winding core for the rope of the block and tackle. With such a construction it is only necessary after use to insert the free end of the rope of the block and tackle in the clamp and to rotate the suspension device about its axis. In this manner, even large lengths of rope are quickly, easily and cleanly wound up. The danger of tangling is practically excluded in this manner.

In order to simplify handling of the apparatus, it is expedient to equip the pulley housing or the roller box with hand grips. These hand grips can if necessary be countersunk which for example is of advantage if the roller box of the suspension device is constructed as a winding core.

Basically, the support element can be secured at the necessary height in any desired manner. For the purpose, preferably walls or ceilings are suitable. it is however particularly advantageous to select a fastening such as is described for example in DE-OS No. 30 07 835. In this known construction, the support element is clamped via a flexible connecting member between the upper edge of the door plate and the lower edge of the corresponding door frame. In order now to be able to adapt the connecting member to possibly differing door thicknesses, it is advantageous to connect the flexible connecting member with the support element to the pulley housing or the roller box in a longitudinally adjustable manner. A clamping arrangement is particularly suitable for this.

Basically, the clamping arrangement can be constructed in any desired manner. It is advantageous if the clamping arrangement has at least one clamping screw by which the flexible connecting member is pressed by means of a clamping plate against a counterbody of the support element.

In a preferred exemplary embodiment, the flexible connecting member consists of two spaced mutually parallel belts which are secured at their ends on a round bar and extend with their free ends through in each case a slit-like channel which is arranged in each case at the end of the pulley housing or the roller box and is provided with in each case one of the above-described clamping arrangements. Such a construction is simple to assemble and allows installation on practically every type of door construction.

In order to prevent the pulley housing or roller box from tilting under load, it is advantageous that the slit-like channel makes an acute angle relative to the vertical. In this manner it is achieved that when the belt engages in the slit-like channel it exerts no tilting moment on the pulley housing or roller box.

In order to simplify securing of the pulley housing or roller box of the support element on a wall or a ceiling it is advantageous to provide this or these with suitable devices. A particularly simple constructions results when such securing devices are constructed as angle or keyhole plates. These can either be connected fast with the pulley housing or roller box or can be supplied as separate parts.

Basically, a device constructed according to the invention can be manufactured from various materials. It is however advantageous to manufacture at least the pulley housing or the roller box and the pulleys from synthetic material.

In the following, for further explanation and for better understanding an exemplary embodiment of the inventive device is described and explained in more detail with reference to the attached drawings.

Figure 1:
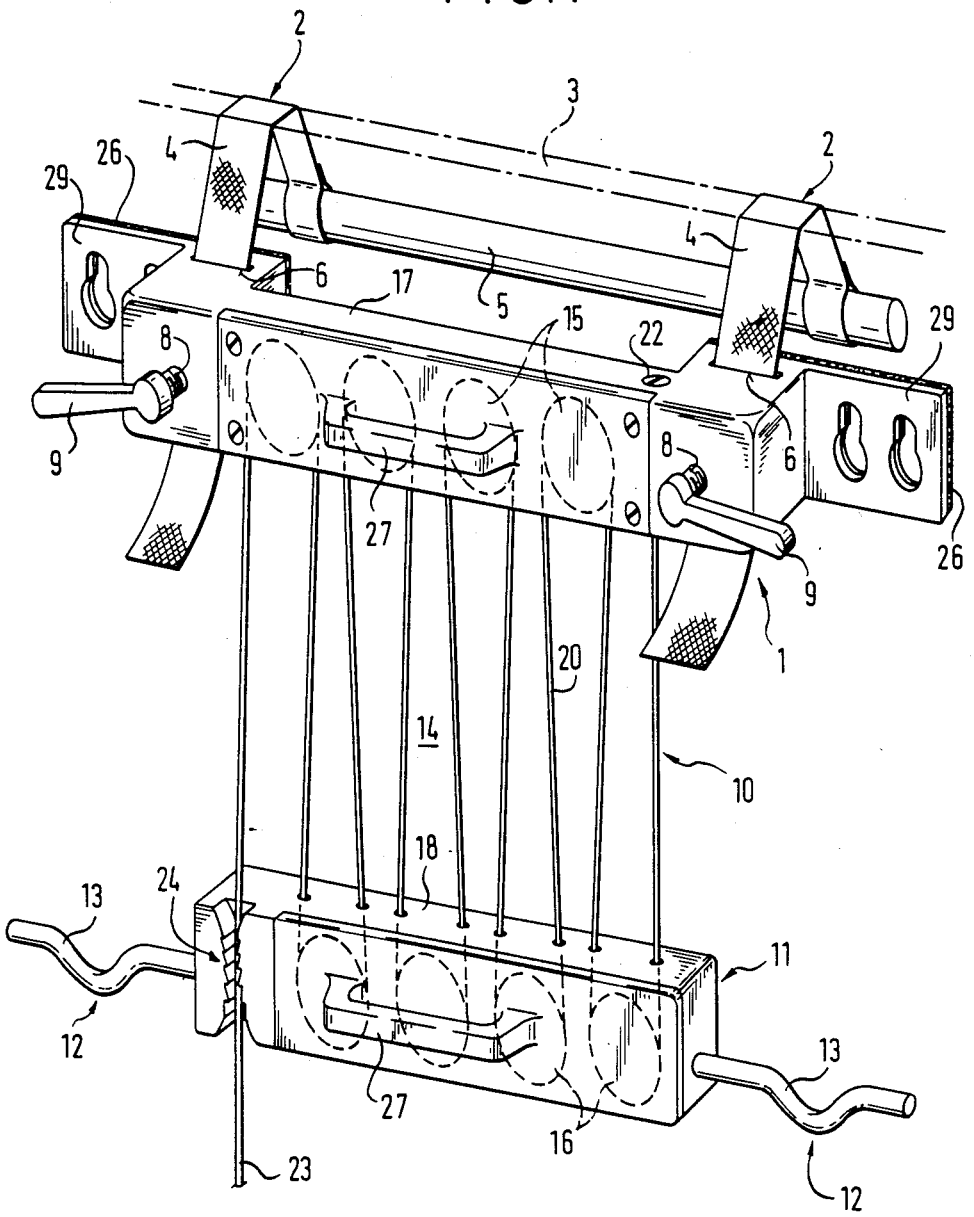
FIG. 1 shows in perspective view a preferred exemplary embodiment of the device according to the invention.
Figure 2:
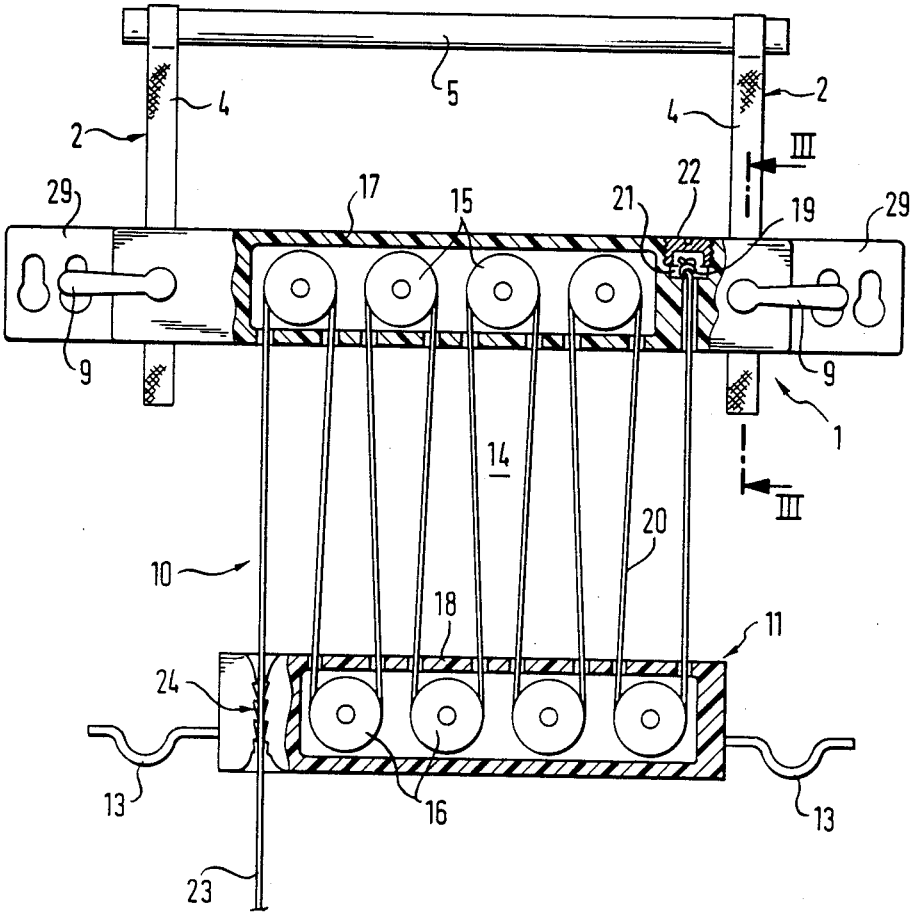
FIG. 2 shows the exemplary embodiment according to FIG. 1 at reduced scale in a front view partially broken away.
Figure 3:
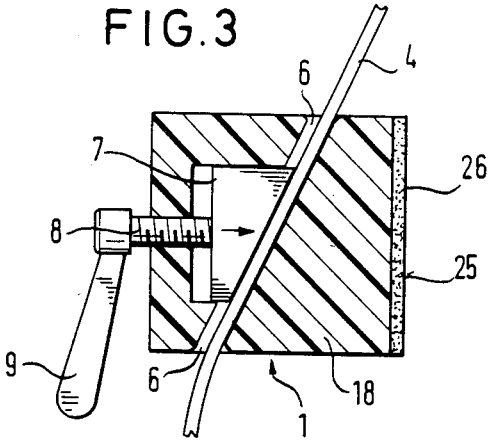
FIG. 3 shows in enlarged scale a section along the plane III—III of FIG. 2.

As appears from FIGS. 1 to 3, the device according to the invention includes a support element 1 which is suspended via a flexible connecting member 2 on the upper edge of a door 3 shown only with chain dotted lines. The flexible connecting member 2 consists of two spaced and mutually parallel belts 4 which are secured with their one end on a round bar 5 and with their free end pass through a slit-like channel 6 (cf. FIG. 3) arranged in the support element 1. Within the channel is arranged a clamping plate 7 which cooperates with a clamping screw 8 which can be rotated by a hand grip 9. If the hand grip 9 and with this the clamping screw is rotated in a clockwise sense, the clamping plate 7 is pressed against the belt 4 and thereby this is secured in the channel 6. If on the other hand the handgrip 9 is rotated in a counterclockwise sense, the clamping plate 7 is withdrawn from the belt 4 whereby this is free in the channel 6 for appropriate longitudinal sliding adjustment.

As may be seen from FIGS. 1 and 2, by means of a cable line 10 there is connected to the support element 1 a suspension device 11 which carries a coupling device 12 in the form of suspension hooks 13 for gaiters.

As appears particularly from FIG. 2, the cable line 10 is constructed in the present exemplary embodiment as a block and tackle 14 whose pulleys 15 and 16 are arranged in each case on the support element 1 or in the suspension device 11. The support element 1 and the suspension device 11 are for this reason constructed in the form of a pulley housing which in the present exemplary embodiment is constructed as a longitudinally extending flat and rectangular roller box 17 or 18.

As may be further seen from FIG. 2, the block and tackle 14 possesses altogether four pulleys 15 secured on the support element 1 and four pulleys 16 secured on the suspension device. The pulleys 15 and 16 lie in each case in one plane, the axes running parallel to one another and being arranged likewise in a common plane adjacent one another. The cable guidance of the block and tackle 14 is in this connection constructed in such manner that the one end 19 of the line 20 is secured on the support element 1. For this purpose, the roller box 17 possesses an aperture 21 in which the end 19 of the line 20 is secured by means of a knot. The aperture 21 is - as may be seen from FIGS. 1 and 2 - closed by means of a plug 22.

From the end 19, the line 20 extends in a zigzag formation across the pulleys 15 and 16. The free end 23 of the line is held releasably in a clamp 24 which is constructed in the present exemplary embodiment as a toothed grip and is integrated in the roller box 18, such as may be seen particularly from FIG. 1.

The exemplary embodiment represented in FIGS. 1 and 2 is additionally provided with a device for fastening on a wall. For this purpose, the support element 1 has in the region of the front ends of the roller box 17 keyhole plates 29 which enables suspension on securing screws or fastening hooks. For ceiling mounting, prepared brackets (not illustrated) can be provided where necessary which can be secured with one end on the ceiling and with their other limb on the keyhole plate 29.

As may be seen from FIG. 3, the channel 6 for the belt 4 extends not parallel to the vertical but at a sharp angle. This has the advantage that during suspension via the belt 4 on the support element 1 no tilting moment is exerted under load so that the support element 1 with its support surface 25 (cf. FIG. 3) always lies flat on the door or the like. In order to prevent scratching of the door, the support surface 25 is covered with a soft layer 26.

To simplify handling, the roller boxes 17 and 18 of the support element 1 and the suspension device 11 are provided in each case on the front side with a hand grip 27, which if necessary can also be countersunk.

Figure 6:
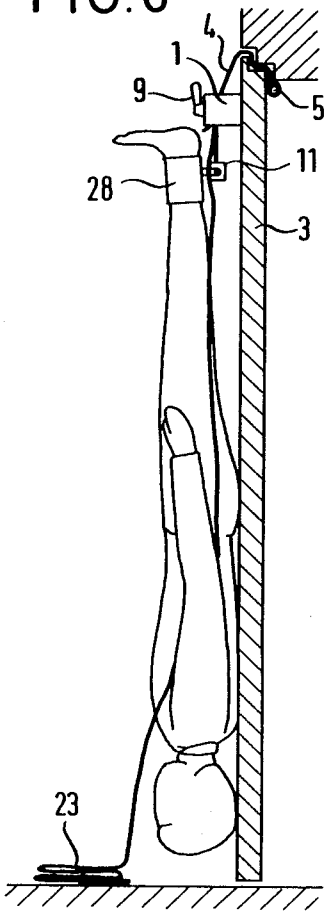
FIGS. 4 to 6 show three differing phases of installation of a device according to the invention.
Figure 5:
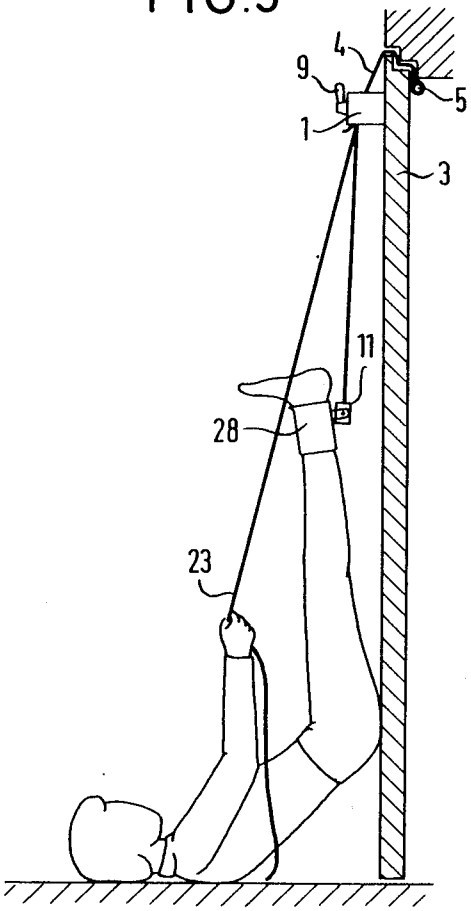
Figure 4:
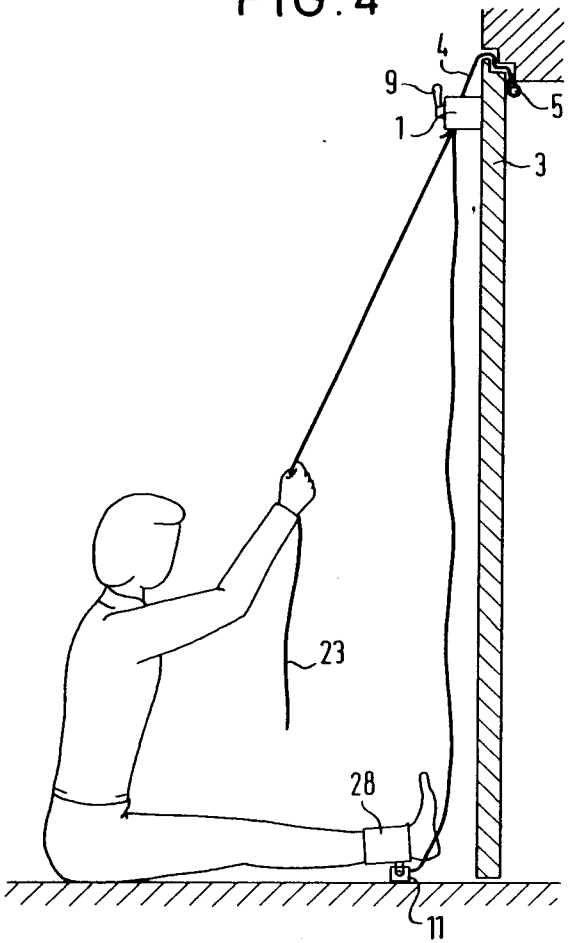

The apparatus described in the foregoing is utilised in the following manner:

In a first step, the support element 1 with the belts 4 is suspended across the upper edge of a door 3 in the manner illustrated in FIGS. 4 to 6 and the door is closed. Following this, the support element 1 is brought to the correct position by means of the clamp handles 9 and the suspension device 11 is lowered to the floor.

When this is accomplished, the patient can don gaiters 28 and connect these by means of the hooks 12 to the suspension device 11. Following this, the free end 23 of the line is released from the cam clamp 24 and actuated by pulling on the block and tackle 14. In this manner, the suspension device 11 and therewith the patient via the gaiters 28 is raised as illustrated in FIG. 5. In an exemplary embodiment according to FIGS. 1 and 2, to lift a patient with a weight of 90 kp only a tension force in the region of 10 kp is necessary.

The block and tackle can be activated until the patient - as illustrated in FIG. 6 - hangs with the head just above the floor. In this position, the patient with his head hanging freely downwards can experience the stretching or relieving influence of gravity.

Figure 7:
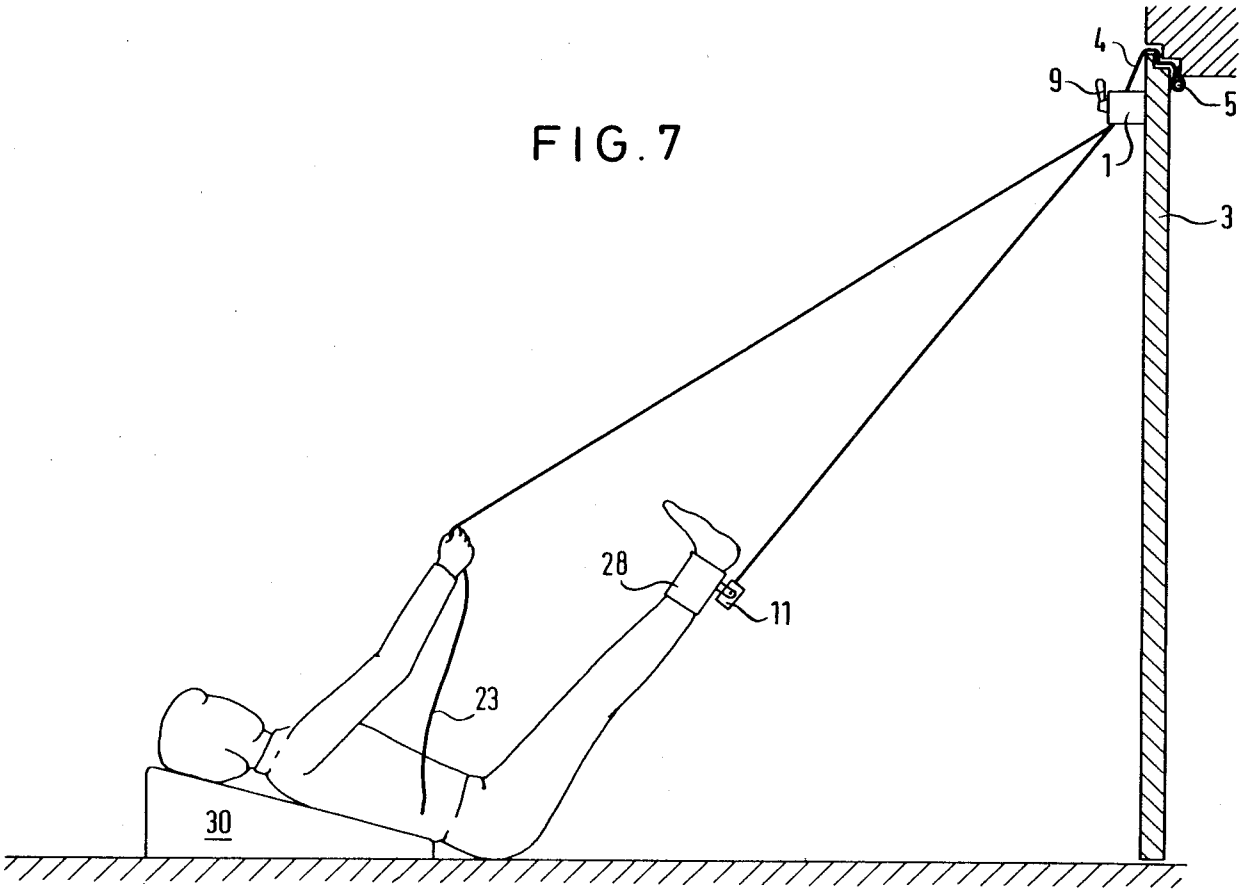
FIG. 7 shows a special purpose modification.

For patients who for health reasons cannot hang freely with their head downwards, it is likewise possible with the apparatus according to the invention to stretch to a certain extent the lumbar vertebrae and the hip joints. For this purpose, the patient need only assume the position illustrated in FIG. 7 and secure the line in the cam clamp. In this position, the patient lies with the back on a cushion 30. The distance of the cushion 30 from the door 3 is here selected so that only the lower part of the lumbar vertebrae and the hip joint are loaded.

I claim:

1. Apparatus for relief of the intervertebral discs and for stretching of the lumbar vertebrae and the hip joints by means of gravity, comprising: a support element for suspension from a door, a wall or the like; a suspension device for suspending a person in an inverted position; a cable line means connecting the suspension device to the support element and having at a free end a lifting line; and a coupling device on the suspension device for coupling of leg engaging means, said suspension device including a clamp means adapted to receive the free end of the cable line means to maintain the suspension device in a locked position relative to the support element whereby the user is maintained in at least a partially inverted position.

2. Apparatus according to claim 1 wherein the cable line means comprises a winding arrangement, the suspension device being secured on the free end of a winding line thereof.

3. Apparatus according to claim 2 wherein an electromotor is provided for driving the winding arrangement.

4. Apparatus according to claim 2 wherein the winding arrangement comprises a block and tackle.

5. Apparatus according to claim 4 wherein the block and tackle has four pulleys secured on the support element and four on the suspension device.

6. Apparatus according to claim 5 wherein said pulleys are arranged lying in one plane horizontally adjacent one another with mutually parallel axes.

7. Apparatus according to claim 5 wherein one end of the cable line of the block and tackle is secured on the support element.

8. Apparatus according to claim 7 wherein the clamp is a toothed grip.

9. Apparatus according to claim 4 wherein the support element and the suspension device each comprise a pulley housing.

10. Apparatus according to claim 9 wherein the pulley housing is a longitudinally extending flat rectangular roller box.

11. Apparatus according to claim 9 wherein the pulley housing of the suspension device carries the coupling device.

12. Apparatus according to claim 11 wherein the coupling device comprises at least one suspension hook.

13. Apparatus according to claim 9 wherein a clamp for one end of the cable line is integrated in the pulley housing.

14. Apparatus according to claim 9 wherein the pulley housing is provided with a hand grip.

15. Apparatus according to claim 9 wherein the pulley housing of the support element is provided with at least one clamping arrangement for flexible connecting means.

16. Apparatus according to claim 15 wherein the clamping arrangement has at least one clamping screw with which via a clamping plate the flexible connecting means is pressable against a counterbody.

17. Apparatus according to claim 15 wherein the flexible connecting means comprises two spaced mutually parallel belts which are each secured with one end on a round shaft and each extend with the other end through a slit-like channel arranged in each case on the pulley housing and provided with the clamping arrangement.

18. Apparatus according to claim 17 wherein the slit-like channel includes an acute angle with respect to the vertical.

19. Apparatus according to claim 9 wherein the pulley housing of the support element is provided with securing means for wall or ceiling mounting.

20. Apparatus according to claim 19 wherein the securing means comprises a bracket or support.

21. Apparatus according to claim 1 wherein at least the pulley housing and the pulleys consist of synthetic material.

* * * * *